US012427399B2

(12) United States Patent
Su et al.

(10) Patent No.: US 12,427,399 B2
(45) Date of Patent: Sep. 30, 2025

(54) KLOTSKI CHESS

(71) Applicant: FS GIIKER TECHNOLOGY CO., LTD., Guangdong (CN)

(72) Inventors: Ziming Su, Foshan (CN); Changping Li, Foshan (CN); Jinpeng Chen, Foshan (CN)

(73) Assignee: FS GIIKER TECHNOLOGY CO., LTD., Foshan (CN)

( * ) Notice: Subject to any disclaimer, the term of this patent is extended or adjusted under 35 U.S.C. 154(b) by 526 days.

(21) Appl. No.: 18/015,594

(22) PCT Filed: Dec. 10, 2021

(86) PCT No.: PCT/CN2021/137002
§ 371 (c)(1),
(2) Date: Jan. 11, 2023

(87) PCT Pub. No.: WO2022/135175
PCT Pub. Date: Jun. 30, 2022

(65) Prior Publication Data

US 2023/0249054 A1 Aug. 10, 2023

(30) Foreign Application Priority Data

Dec. 26, 2020 (CN) ..... 202023190672.3
Dec. 26, 2020 (CN) ..... 202122291657.6
Dec. 26, 2020 (CN) ..... 202122291687.7

(51) Int. Cl.
*A63F 3/00* (2006.01)

(52) U.S. Cl.
CPC ..... *A63F 3/00643* (2013.01); *A63F 3/00634* (2013.01); *A63F 2003/0063* (2013.01);
(Continued)

(58) Field of Classification Search
CPC ..... A63F 3/00643; A63F 2003/0063; A63F 2003/00637; A63F 2003/0064; A63F 3/00634
See application file for complete search history.

(56) References Cited

U.S. PATENT DOCUMENTS 1,477,371 A * 12/1923 Larabee ..... A63F 9/0807 273/153 S
1,534,599 A * 4/1925 Mclennan ..... A63F 9/0807 273/153 S
(Continued)

FOREIGN PATENT DOCUMENTS

CN 2439305 Y 7/2001
CN 2673467 Y 1/2005
(Continued)

OTHER PUBLICATIONS

Chinese Patent Office: Notifications of Acceptance of Request for Invalidation of CN 2020231906723 (related application); Oct. 24, 2022; 36 page.
(Continued)

*Primary Examiner* — Morgan T Jordan

(57) ABSTRACT

The present application relates to a klotski game including a plurality of game pieces, a game board and a prompter. The plurality of game pieces includes a decisive game piece. The game board is configured to accommodate the plurality of game pieces and the game board is provided with an exit. The prompter is configured to indicate that a game of the klotski game is over when the decisive game piece is moved to a position corresponding to the exit on the game board.

18 Claims, 4 Drawing Sheets

(52) U.S. Cl.
CPC ..... *A63F 2003/00652* (2013.01); *A63F 2003/00668* (2013.01)

(56) References Cited

U.S. PATENT DOCUMENTS

| | | | | | |
|---|---|---|---|---|---|
| 2,788,975 | A | * | 4/1957 | Lichtenberger | A63F 9/12 434/335 |
| 4,346,889 | A | * | 8/1982 | Barlow | A63F 9/00 273/284 |
| 4,470,601 | A | * | 9/1984 | Finn | A63F 9/0803 273/281 |
| 4,796,891 | A | * | 1/1989 | Milner | A63F 9/0807 273/238 |
| 4,819,945 | A | * | 4/1989 | Porcheddu | A63F 3/0423 273/287 |
| 4,836,548 | A | * | 6/1989 | Chittenden | A63F 9/0803 273/153 S |
| 4,927,150 | A | * | 5/1990 | Monoyios | A63F 9/0807 273/153 S |
| 5,205,557 | A | * | 4/1993 | Kuo | A63F 9/0078 273/281 |
| 5,437,459 | A | * | 8/1995 | Kirby | A63F 3/00634 273/281 |
| 6,116,600 | A | * | 9/2000 | Aryan | A63F 9/0807 273/156 |
| 8,613,448 | B1 | * | 12/2013 | Fraze | A63F 9/08 273/153 S |
| 2007/0200292 | A1 | * | 8/2007 | Nesis | A63F 9/0803 273/153 S |
| 2015/0196837 | A1 | | 7/2015 | Stromberg | |
| 2017/0087454 | A1 | * | 3/2017 | Reichmuth | A63F 3/02 |

FOREIGN PATENT DOCUMENTS

| | | | | |
|---|---|---|---|---|
| CN | 2708966 | Y | | 7/2005 |
| CN | 201006286 | Y | | 1/2008 |
| CN | 201179326 | Y | * | 1/2009 |
| CN | 100534559 | C | * | 9/2009 |
| CN | 204093012 | U | * | 1/2015 |
| CN | 205598610 | U | | 9/2016 |
| CN | 206543398 | U | | 10/2017 |
| CN | 206604166 | U | | 11/2017 |
| CN | 207822484 | U | | 9/2018 |
| CN | 207950580 | U | | 10/2018 |
| CN | 109420332 | A | | 3/2019 |
| CN | 209316991 | U | | 8/2019 |
| CN | 110478887 | A | | 11/2019 |
| CN | 209865256 | U | | 12/2019 |
| CN | 210495166 | U | | 5/2020 |
| CN | 211050880 | U | | 7/2020 |
| CN | 111939547 | A | | 11/2020 |
| CN | 212141432 | U | * | 12/2020 |
| CN | 213375089 | U | * | 6/2021 |
| CN | 213884965 | U | | 8/2021 |
| CN | 214019152 | U | * | 8/2021 |
| CN | 214627070 | U | | 11/2021 |
| EP | 0081617 | A1 | | 6/1983 |
| JP | S59167577 | U | | 11/1984 |
| JP | H079392 | U | | 2/1995 |
| JP | 2000288156 | A | | 10/2000 |
| JP | 3166291 | U | * | 2/2011 |
| TW | 200529911 | A | * | 9/2005 |
| WO | 0211836 | A1 | | 2/2002 |

OTHER PUBLICATIONS

Chinese Patent Office: Notifications of Acceptance of Request for Invalidation of CN 2021222916576 (related application); Jan. 18, 2023; 18 page.

Chinese Patent Office: Office Action of CN 202122291687.7 (related application); Apr. 24, 2022; 2 pages.

Chinese Patent Office: Office Action of CN 202122291687.7 (related application); Dec. 31, 2021; 1 page.

Patent Cooperation Treaty: International Search Report and Written Opinion for PCT/CN2021/137002; Mar. 9, 2022; 12 pages.

Japanese Patent Office; Notice of Reasons for Refusal for Japanese Patent Application 2023-539139 (related application); Kishi, Satoshi; Jun. 4, 2024; 8 pages.

Wu, Heling: Tangram, Chinese Rings (Nine Linked Rings), and Huarong Road: The Three Classics of Traditional Chinese Puzzle Games; Chinese Science Publishing & Media; Dec. 2004; 187-190.

* cited by examiner

KLOTSKI CHESS

CROSS-REFERENCE TO RELATED APPLICATIONS

This application is a U.S. National Phase application submitted under 35 U.S.C. § 371 of Patent Cooperation Treaty application serial no. PCT/CN2021/137002 filed on Dec. 10, 2021, and entitled KLOTSKI CHESS which claims priority to Chinese Patent Applications No. 202023190672.3, No. 202122291657.6 and No. 202122291687.7, filed on Dec. 26, 2020. The entire contents of the above applications are incorporated herein in their entireties.

Patent Cooperation Treaty application serial no. PCT/CN2021/137002, published as WO 2022/135175 A1.

TECHNICAL FIELD

The present application relates to the technical field of board games, and more particularly relates to a klotski game.

BACKGROUND

A klotski game is an ancient Chinese folk puzzle game, with its changeable and interesting characteristics, together with Rubik's Cube and Peg Solitaire, they have been called "three incredible games in puzzle games" by foreign intelligence experts. A klotski game includes four square game pieces each having a side length of one-unit length, five rectangular game pieces each having a length of two-unit lengths and a width of one-unit length, and one square game piece having a side length of two-unit lengths. The square game piece having a side length of two-unit lengths is a decisive game piece. A game board is generally a wooden board dug with a rectangular recess having a length of five-unit lengths and a width of four-unit lengths. The method for playing the game is to shift each of the game pieces without lifting the game pieces, and to try to use the fewest steps to help the decisive game piece be shifted from an initial position to a specific position of "exit" on the game board to achieve "escape", so that the game is over.

For a conventional klotski game, a user usually determines by himself/herself whether the decisive game piece has moved to the specific position of "exit" in the game board to achieve "escape". However, for a user who is not familiar with rules of the klotski game, or when an oversight occurs during the game, the user probably cannot determine in time that the decisive game piece has moved to the "exit", and are unaware of that the game is over.

SUMMARY

Based on the above, it is necessary to provide a klotski game.

A klotski game is provided, including a plurality of game pieces, a game board and a prompter. The plurality of game pieces includes a decisive game piece. The game board is configured to accommodate the plurality of game pieces and the game board is provided with an exit. The prompter is configured to indicate that a game of the klotski game is over when the decisive game piece is moved to a position corresponding to the exit on the game board.

According to the above apparatus for playing the klotski game, by providing the prompter, when the decisive game piece is moved to a position corresponding to the "exit" on the game board, the prompter indicates that the game of the klotski game is over, so as to prompt a user that the decisive game piece has "escaped" and the game is over, thereby providing an automatic prompting function for the game and improving the experience of the user.

In one of the embodiments, the decisive game piece is provided with a first sensing element, and the game board is provided with a second sensing element matching the first sensing element at a position corresponding to the exit; and the second sensing element is electrically connected to the prompter, and the prompter is provided on the game board; or the first sensing element is electrically connected to the prompter, and the prompter is provided on the decisive game piece.

In one of the embodiments, the decisive game piece includes an upper casing and a lower casing nested and fitted with each other, and the first sensing element is located between the upper casing and the lower casing.

In one of the embodiments, the game board includes an upper board body and a lower board body nested and fitted with each other, and the second sensing element is located between the upper board body and the lower board body.

In one of the embodiments, a smart display region is provided on the game board; and the smart display region is provided with a display screen, and the prompter includes the display screen.

In one of the embodiments, the smart display region is further provided with a processing module and a power supply module; the power supply module supplies power to the display screen and the processing module; the display screen is located on a surface of the smart display region; the processing module is located inside the smart display region; the display screen is electrically connected to an output end of the processing module, and the second sensing element is electrically connected to an input end of the processing module.

In one of the embodiments, the smart display region is further provided with a control button module, and the control button module is electrically connected to the input end of the processing module.

In one of the embodiments, the display screen is a touch screen, and the display screen is further electrically connected to the input end of the processing module.

In one of the embodiments, the display screen is provided with a 4×5-grid color rendering region, the color rendering region is configured to be capable of displaying at least three different colors, and each of the colors is configured to respectively correspond to a different type of game pieces among the plurality of game pieces.

In one of the embodiments, the prompter includes a buzzer, a screen, or an LED light.

In one of the embodiments, a first accommodating cavity is provided in each of the game pieces, a first magnetic member is provided in the first accommodating cavity; a second accommodating cavity is provided in the game board, and a second magnetic member capable of attracting the first magnetic member is provided in the second accommodating cavity.

In one of the embodiments, the first sensing element is a magnetic element, a magnetic pole of the first sensing element is opposite to a magnetic pole of the first magnetic member, and the second sensing element is a Hall sensor.

In one of the embodiments, an upper surface of the game board is provided with a concave game piece sliding recess, the second magnetic member is arranged in an area where the game piece sliding recess is located, and the game pieces are attachable within the game piece sliding recess.

In one of the embodiments, a height of the game piece is greater than a depth of the game piece sliding recess.

In one of the embodiments, a wedge-shaped protrusion is provided at a corner of the game board.

In one of the embodiments, the first magnetic member and the second magnetic member are circular magnets.

In one of the embodiments, the game pieces further include first-typed game pieces and second-typed game pieces, each of the first-typed game pieces is a square game piece having a length of one-unit length and a width of one-unit length, each of the second-typed game pieces is a rectangular game piece having a length of two-unit lengths and a width of one-unit length, and the decisive game piece is a square game piece having a length of two-unit lengths and a width of two-unit lengths.

In one of the embodiments, twenty second magnetic members are arranged in a 4×5 matrix in the game board; each of the first-typed game pieces is provided with one first magnetic member, the decisive game piece is central symmetrically provided with two first magnetic members or four first magnetic members, and each of the second-type game pieces is provided with two first magnetic members which are symmetrical with respect to a central line.

In one of the embodiments, the first magnetic member is swingable in the first accommodating cavity.

Further, in one of the embodiments, a bottom surface of the first magnetic member is disposed on a bottom wall of the first accommodating cavity, an angle between the bottom surface of the first magnetic member and the bottom wall of the first accommodating cavity is a first swing angle, and the first swing angle is less than or equal to 45°.

Further, in one of the embodiments, when the each of the game pieces is moved in position, the first magnetic member slaps an inner wall of the first accommodating cavity by swinging.

In one of the embodiments, the second magnetic member is swingable in the second accommodating cavity.

Further, in one of the embodiments, a bottom surface of the second magnetic member is disposed on a bottom wall of the second accommodating cavity, an angle between the bottom surface of the second magnetic member and the bottom wall of the second accommodating cavity is a second swinging angle, and the second swinging angle is less than or equal to 45°.

Further, in one of the embodiments, when the game piece is moved in position, the second magnetic member slaps an inner wall of the second accommodating cavity by swinging.

Details of one or more embodiments of the present application are set forth in the accompanying drawings and description below. Other features, objects, and advantages of the present application will become apparent from the description, drawings, and claims.

BRIEF DESCRIPTION OF THE DRAWINGS

For a more complete understanding, reference is now made to the following description taken in conjunction with the accompanying Drawings in which:

To describe the technical solutions in the embodiments of the present application more clearly, the following briefly introduces the accompanying drawings required for describing the embodiments. Apparently, the accompanying drawings in the following description show merely some embodiments of the present application, and those of ordinary skill in the art may still derive drawings of other embodiments from these accompanying drawings without creative efforts.

In the drawings:

FIG. 1 is a schematic assembly diagram of a klotski game in an embodiment.

FIG. 2 is a schematic exploded view of the klotski game shown in FIG. 1.

FIG. 3 is a schematic exploded view of the klotski game shown in FIG. 1 from another perspective.

FIG. 4 is a schematic diagram illustrating changes in positions of a first magnetic member and a second magnetic member during movements of a game piece of the klotski game in an embodiment.

Figure 1:
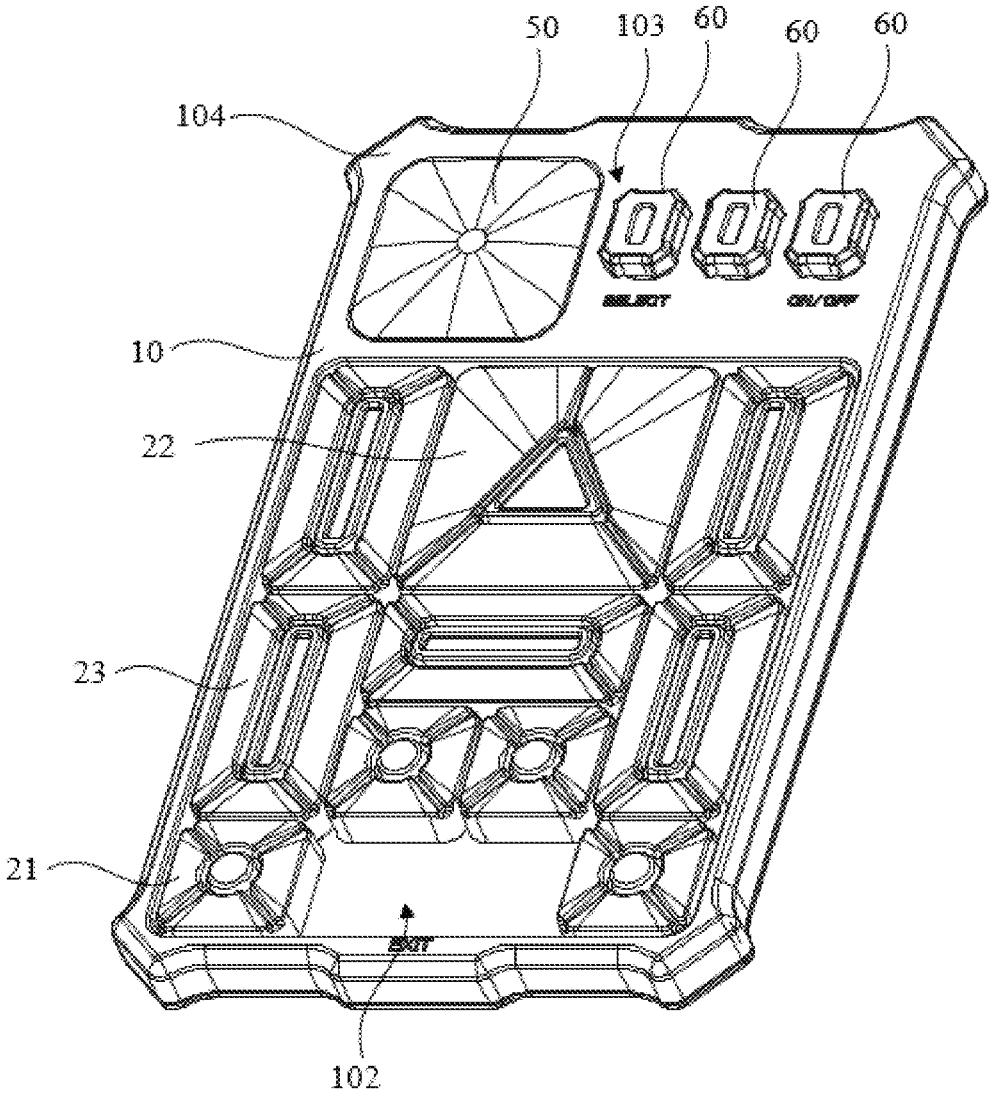

REFERENCE NUMERALS game board 10; upper board body 110; lower board body 120; second accommodating cavity 101; game piece sliding recess 102; smart display region 103; wedge-shaped protrusion 104; game piece 20; upper casing 210; lower casing 220; first accommodating cavity 201; first-typed game piece 21; decisive game piece 22; second-typed game piece 23; first magnetic member 30; second magnetic member 40; display screen 50; control button module 60; processing module 70; power supply module 80; second sensing element 90; first sensing element 100.

DETAILED DESCRIPTION

In order to make the above purposes, features and advantages of the present application more apparent and better understood, embodiments of the present application will be fully described hereinafter with reference to the accompanying drawings. In the following description, many specific details are explained in order to fully understand the present application. However, the present application can be implemented in many other ways than those described herein, and similar modifications may be made by those skilled in the art without departing from the scope of the application, which is therefore not to be limited to the specific embodiments disclosed below.

Figure 2:
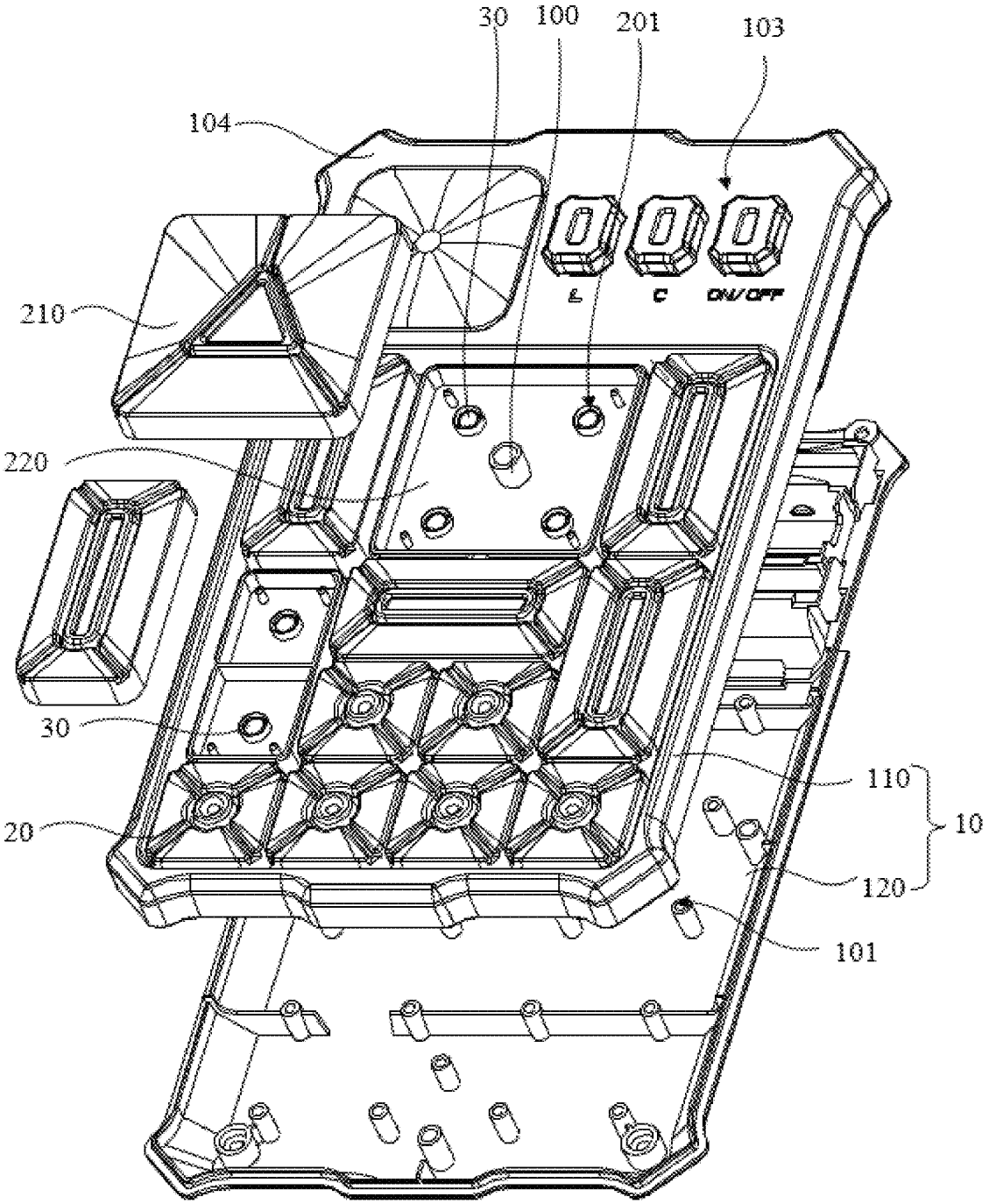
Figure 3:
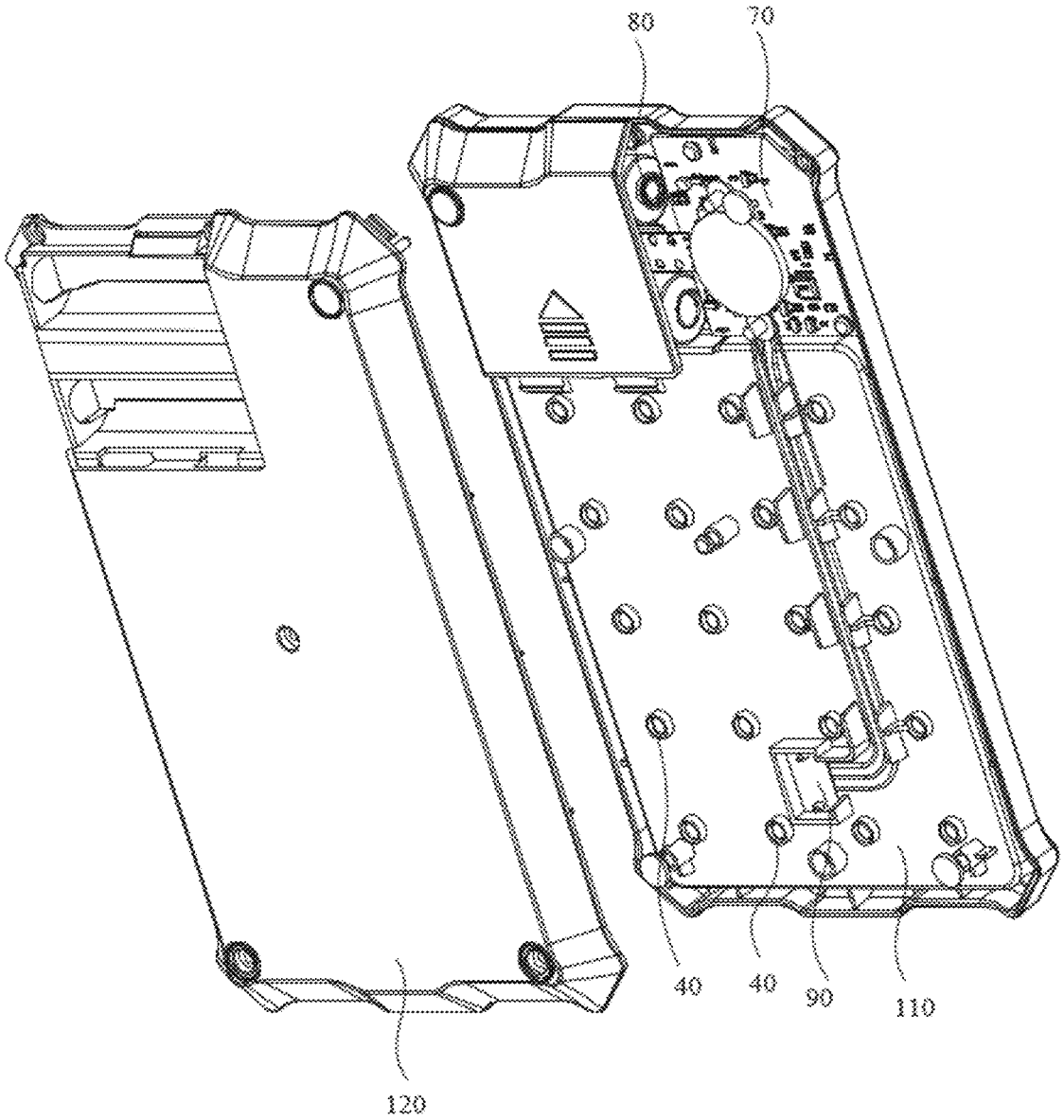

Please refer to FIGS. 1-3. In an embodiment, a klotski game is provided, including a prompter, a game board 10, and a plurality of game pieces 20. The game pieces 20 include a decisive game piece 22. The decisive game piece 22 is provided with a first sensing element 100. The game board 10 is provided with a second sensing element 90 matching the first sensing element 100 at a position corresponding to an exit for the decisive game piece 22. The second sensing element 90 is electrically connected to the prompter that is provided on the game board 10.

By providing the first sensing element 100 in the decisive game piece 22, and providing the game board 10 with the second sensing element 90 matching the first sensing element 100 at a position corresponding to an exit for the decisive game piece 22, when the decisive game piece 22 is moved to a position corresponding to "exit" of the game board 10, the second sensing element 90 can sense the first sensing element 100 and transmit a signal to the prompter. A sound, an image or a light or the like are emitted/shown by the prompter to prompt a user that the decisive game piece 22 has "escaped", and the game is over. In this way, the game has an automatic prompting function, thereby improving user experiences. In the present embodiment, the prompter is a display screen 50, and the user is prompted, by using an image shown on the display screen 50, that the game is over. Optionally, a speaker may be provided on the game board 10 and using the sound to prompt the user.

In other embodiments, the prompter can also be provided on the decisive game piece 22, and the first sensing element 100 is electrically connected to the prompter. Optionally, the prompter is a buzzer, a screen, or an LED light, and the user is prompted by a sound of the buzzer, an image of the screen, or a light of the LED light.

In one of the embodiments, the decisive game piece 22 includes an upper casing 210 and a lower casing 220 that can be nested and fitted with each other, and the first sensing element 100 is located between the upper casing 210 and the lower casing 220. This can ensure that the overall structure of the game piece 20 is compact, and facilitate the installation of the first sensing element 100.

Referring to FIG. 2 and FIG. 3, in one of the embodiments, the game board 10 includes an upper board body 110 and a lower board body 120 that can be nested and fitted with each other, and the second sensing element 90 is located between the upper board body 110 and the lower board body 120. This can ensure that the overall structure of the game board 10 is compact, and facilitate the installation of the second sensing element 90.

Referring to FIG. 1, in one of the embodiments, a smart display region 103 is provided on a game board 10, and the display screen 50 is arranged in the smart display region 103. The smart display region 103 may also be provided with a control button module 60, a processing module 70, and a power supply module 80. The power supply module 80 supplies power to the display screen 50 and the processing module 70. The display screen 50 is located on a surface of the smart display region 103. The processing module 70 is located inside the smart display region 103, and the control button module 60 is electrically connected to an input end of the processing module 70. The display screen 50 is electrically connected to an output end of the processing module 70, and the second sensing element 90 is electrically connected to the input end of the processing module 70. The prompter includes the display screen 50. The second sensing element 90 transmits a signal to the processing module 70 after sensing the first sensing element 100, and the processing module 70 displays, through the display screen 50, that the game is over. The control button module 60 may include one or more multi-function buttons, for example, including three multi-function buttons as shown in FIG. 1. The three multi-function buttons are electrically connected to the input end of the processing module 70, and can respectively implement functions such as "ON/OFF", "volume up", "volume down", "confirm", "select", and "cancel". The display screen 50 is electrically connected to the output end of the processing module 70, and can display a "menu" screen, a "puzzle layout" screen, a "puzzle-solving prompt" screen or the like. The display screen 50 is provided with a 4×5-grid color rendering region, the color rendering region is configured to be able to display at least three different colors, and each of the colors is configured to respectively correspond to a different type of game pieces 20.

The display screen 50 may be a non-touch screen or a touch screen. When the display screen 50 is a touch screen, in another embodiment, the smart display region 103 may not be provided with the control button module 60, but is provided with the touch screen, the processing module 70 and the power supply module 80. The power supply module 80 supplies power to the touch screen and the processing module 70. The touchscreen is located on a surface of the smart display region 103. The processing module 70 is located inside the smart display region 103, and the touch screen is electrically connected to an input end and an output end of the processing module 70. The second sensing element 90 is electrically connected to the input end of the processing module 70. The prompter includes the touch screen. The second sensing element 90 transmits a signal to the processing module 70 after sensing the first sensing element 100, and the processing module 70 displays, through the touch screen, that the game is over. In this embodiment, a button control function and a display function can be implemented by using the touch screen.

In one of the embodiments, a first accommodating cavity 201 is provided in the game piece 20, and a first magnetic member 30 is provided in the first accommodating cavity 201. A second accommodating cavity 101 is provided in the game board 10, and a second magnetic member 40 capable of attracting the first magnetic member 30 is provided in the second accommodating cavity 101. The first sensing element 100 is a magnetic element, and a magnetic pole of the first sensing element 100 is opposite to a magnetic pole of the first magnetic member 30. The second sensing element 90 is a Hall sensor. By providing the first magnetic member 30 in the game piece 20, and providing the second magnetic member 40 magnetically attracting the first magnetic member 30 in the game board 10, the game pieces 20 can be stably attached to the game board 10, so that the game pieces 20 are not easy to fall off, and the game pieces 20 are avoided from being lost, facilitating the convenience of storage and carrying. Furthermore, the magnetic pole of the first sensing element 100 is opposite to the magnetic pole of the first magnetic member 30, so that the Hall sensor can accurately sense the magnetic element of the decisive game piece 22, and will not cause erroneous signal transmission due to that the first magnetic member 30 in the game piece 20 is incorrectly sensed.

Optionally, in other embodiments, the first sensing element 100 and the second sensing element 90 may be electronic components such as rocker switches or trigger switches matched with each other.

Specifically, referring to FIG. 1 and FIG. 2, an upper surface of the game board 10 is provided with a concave game piece sliding recess 102, and the second magnetic member 40 is arranged in an area where the game piece sliding recess 102 is located. The game pieces 20 can be attached within the game piece sliding recess 102. The game piece sliding recess 102 is an area in which the game pieces 20 slide. The second magnetic member 40 is arranged under a bottom of the game piece sliding recess 102, so that the game pieces 20 can be stored in the game piece sliding recess 102, and are not easily lost.

In one of the embodiments, a height of the game piece 20 is greater than a depth of the game piece sliding recess 102. That is, an upper end of the game piece 20 extends out of the game piece sliding recess 102, so that it is convenient for the user to move the game piece 20 when playing the game.

Referring to FIG. 1 and FIG. 2, in one of the embodiments, a wedge-shaped protrusion 104 is provided at a corner of the game board 10. The wedge-shaped protrusion 104 can serve functions of location limitation and anti-slip, so that the user can hold the game board 10 with one hand, thereby improving the use convenience.

Further, twenty second magnetic members 40 are arranged in a 4×5 matrix in the game board 10. The game pieces 20 further include first-typed game pieces 21 and second-typed game pieces 23. The first-typed game piece 21 is a square game piece having a length of one-unit length and a width of one-unit length, and the second-typed game piece 23 is a rectangular game piece having a length of two-unit lengths and a width of one-unit length. The decisive game piece 22 is a square game piece having a length of two-unit lengths and a width of two-unit lengths. Each of the first-typed game pieces 21 is provided with one first magnetic member 30. The decisive game piece 22 is central symmetrically provided with two first magnetic members 30 or four first magnetic members 30. That is, two first magnetic members 30 are symmetrically arranged along a diagonal direction of the decisive game piece 22, or four first magnetic members 30 are evenly arranged in the decisive game piece 22. Each first magnetic member 30 is disposed at a position such that it can correspondingly attracts the second magnetic member 40 at a position corresponding to each unit after the decisive game piece 22 is placed in position. By providing two first magnetic members 30 symmetrically, a force balance can be maintained during the movement of the decisive game piece 22. In addition, by providing four first magnetic members 30, force balance and smooth movement of the decisive game piece 22 can be achieved. Each of the second-typed game pieces 23 is provided with two first magnetic members 30 which are symmetrical with respect to a central line, so that a force balance can be maintained during the movement of the second-typed game piece 23.

In one of the embodiments, the first magnetic member 30 can swing in the first accommodating cavity 201, and a bottom surface of the first magnetic member 30 is disposed on a bottom wall of the first accommodating cavity 201. An angle between the bottom surface of the first magnetic member 30 and the bottom wall of the first accommodating cavity 201 is a first swing angle, and the first swing angle is less than or equal to 45°. During the playing of the game, the movement of the game piece 20 drives the movement of the first magnetic member 30 therein. Since the second magnetic member 40 is provided at a position of the game board 10 corresponding to the position where the game piece 20 is placed, under the influence of the magnetic field formed by the second magnetic member 40, when the first magnetic member 30 leaves a current position and gradually comes to a next position, the first magnetic member 30 is subjected to a certain repulsive force to swing to a certain extent with respect to the bottom wall of the first accommodating cavity 201. As the game piece 20 is moved in position, at this time, the first magnetic member 30 is reversely swung to slap the bottom wall of the first accommodating cavity 201 by a magnetic attraction force of the second magnetic member 40 so as to emit a sound to prompt the user that the game piece 20 has been placed in position. In this embodiment, the first swing angle is set to be less than or equal to 45°, and a height of the first accommodating cavity 201 can be set to be lower, and at the same time, a requirement of sound emitting interaction can be met. In addition, since the first swing angle of the first magnetic member 30 is less than or equal to 45°, even if the first magnetic member 30 swings during movement, the magnetic pole will not be turned over and changed, so as to ensure that the magnetic pole of the first magnetic member 30 remains the same and is opposite to that of the first sensing element 100 all the time, without affecting sensing the first sensing element 100 by the second sensing element 90.

Figure 4:
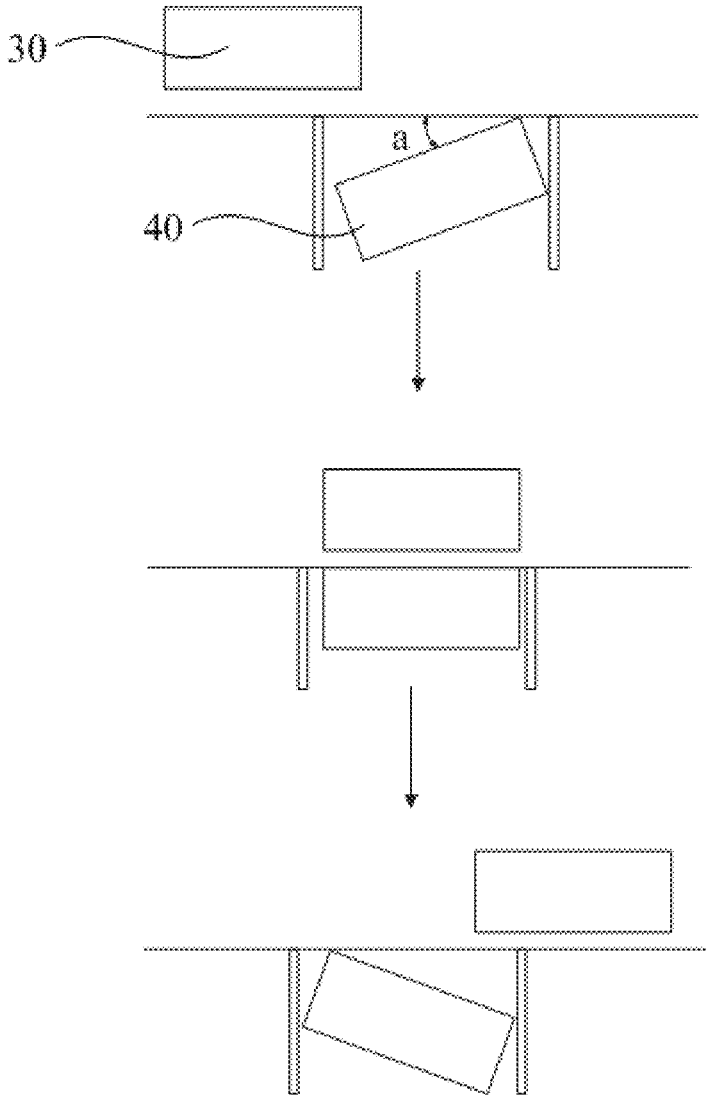

Optionally, referring to FIG. 4, in other embodiments, the second magnetic member 40 can swing in the second accommodating cavity 101, and a bottom surface of the second magnetic member 40 is disposed on a bottom wall of the second accommodating cavity 101. An angle between the bottom surface of the second magnetic member 40 and the bottom wall of the second accommodating cavity 101 is a second swing angle a, and the second swing angle is less than or equal to 45°. In this embodiment, the second magnetic member 40 in the game board 10 swings along with the movement of the game piece 20. When the game piece 20 is placed in position, the second magnetic member 40 is reversely swung to slap a top wall of the second accommodating cavity 101 by a magnetic attraction force of the first magnetic member 30, so as to emit a sound to prompt the user that the game piece 20 has been placed in position. In this embodiment, the second swing angle is set to be less than or equal to 45°, and a height of the second accommodating cavity 101 can be set to be lower, and at the same time, the requirement of sound emitting interaction can be met. Optionally, in other embodiments, the swing angle of the second magnetic member 40 may be greater than 45°, and the second magnetic member 40 may flip and change its orientation during the movement of the game piece 20 according to the magnetic pole of the first magnetic member 30 in the corresponding position. During an assembly process, it is not strictly required that the magnetic pole of the second magnetic member 40 is opposite to that of the first magnetic member 30. In this way, the installation efficiency of the second magnetic member 40 can be effectively improved, and at the same time, the requirement of sound emitting interaction can also be met.

A gap is reserved between the first magnetic member 30 and the first accommodating cavity 201 and/or between the second magnetic member 40 and the second accommodating cavity 101. During the playing of the game, the magnetic attraction force between the first magnetic member 30 and the second magnetic member 40 will change correspondingly as the corresponding distance therebetween changes, thereby causing the first magnetic member 30 and/or the second magnetic member 40 to swing during the movement of the game piece 20. The swinging of the first magnetic member 30 may cause the inner wall of the first accommodating cavity 201 to be slapped and/or the swinging of the second magnetic member 40 may cause the inner wall of the second accommodating cavity 101 to be slapped. The sound or the sense of vibration will be transmitted to the user so that the user can know that the game piece 20 has been aligned to a certain position where the game piece 20 can be placed, and thus a better interaction effect is provided.

Further, the first magnetic member 30 and the second magnetic member 40 are circular magnets. Optionally, the first magnetic member 30 and the second magnetic member 40 may also be other types of magnets. The first magnetic member 30 and the second magnetic member 40 are both magnetic components, and are respectively provided with a magnetic field to form a superimposed magnetic field. When the game piece 20 moves, the swingable "movable part" (the first magnetic member 30 or the second magnetic member 40 that can swing) contained inside the game piece 20 swings correspondingly under the change of the magnetic field, so that an end face of the first magnetic member 30 keeps directly facing the second magnetic member 40, thereby avoiding the problem of the contradiction between the game board 10 and the game pieces 20. A track of the game piece 20 of the klotski game that can be moved in the game board 10 is referred to as a "path", and intersection points of the "paths" are positioning points. These positioning points present a characteristic of being arranged in a matrix. The second magnetic members 40 are embedded in the game board according to the positions of the positioning points. These second magnetic members 40 are adapted in size to the first magnetic members 30, so that an obvious magnetic attraction positioning effect is generated when the game piece 20 is about to reach a positioning point, thereby effectively improving the use experience of the klotski game.

In the description of the present application, it should be understood that the orientation or position relations indicated by the terms "center", "longitudinal", "lateral", "length", "width", "thickness", "upper", "lower", "front", "rear", "left", "right", "vertical", "horizontal", "top", "bottom", "inner", "outer", "clockwise" "counterclockwise" "axial", "radial", "circumferential", etc. are based on the orientation or position relations shown in the figures. It is only for the convenience of describing the present application and simplifying the description, rather than indicating or implying that the indicated device or element must have a particular orientation, be constructed and operated in a particular orientation. Therefore, it cannot be understood that the present application is limited thereto.

In addition, terms such as "first" and "second" are used herein for purposes of description and are not intended to indicate or imply relative importance or significance or to imply the number of indicated technical features. Thus, the features defined by "first" and "second" may explicitly or implicitly include at least one feature. In the description of the present application, the meaning of "a plurality of" is at least two, for example, two, three, etc., unless specifically defined otherwise.

In the present application, unless specified or limited otherwise, terms such as "installed", "connected", "connected to", and "fixed" should be understood broadly, and may be, for example, fixed connections, detachable connections, or integral connections; may also be mechanical or electrical connections; may also be direct connections or indirect connections via intervening structures; may also be inner communications of two elements or interaction relationships between two elements, unless expressly defined otherwise. The specific meanings of the above terms in the present application can be understood by those skilled in the art according to specific situations.

In the present application, unless specified or limited otherwise, a first feature "on" or "under" a second feature may mean that the first feature is in direct contact with the second feature, or that the first feature and the second feature are in indirect contact via an intermediary. Further, a first feature "on", "above", or "on top of" a second feature may include an embodiment in which the first feature is right above or obliquely above the second feature, or just means that the first feature is at a height higher than that of the second feature. The first feature "below", "under", or "on bottom of" the second feature may include an embodiment in which the first feature is right below or obliquely below the second feature, or just means that the first feature is at a height lower than that of the second feature.

It should be noted that when an element is referred to as being "fixed to" or "disposed on" another element, the element may be directly on the other element or a central element may also exist. When an element is referred to as being "connected" to another element, it may be directly connected to the other element or intervening elements may be present at the same time. The terms "vertical", "horizontal", "upper", "lower", "left", "right" and similar expressions as used herein are for illustrative purposes only and are not meant to be the only embodiments.

Various technical features of the described embodiments can be combined in any way, and in order to make the description brief, all possible combinations of the technical features in the described embodiments are not described. However, as long as the combinations of these technical features are not contradictory, all of them should be considered to belong to the scope of the description.

The foregoing embodiments merely represent several implementations of the present application, and are described in detail, but are not intended to limit the scope of the claims. It should be noted that, for those skilled in the art, various modifications and improvements can be made without departing from the concept of the present application, and all these modifications and improvements belong to the scope of protection of the present application. Therefore, the scope of protection of the present application should be subject to the appended claims.

The invention claimed is:

1. A klotski game, comprising:

a plurality of game pieces comprising a decisive game piece;

a game board, configured to accommodate the plurality of game pieces and provided with an exit; and a prompter, configured to indicate that a game of the klotski game is over when the decisive game piece is moved to a position corresponding to the exit on the game board.

2. The klotski game of claim 1, wherein the decisive game piece is provided with a first sensing element, and the game board is provided with a second sensing element matching the first sensing element at a position corresponding to the exit, and wherein:

the second sensing element is electrically connected to the prompter, and the prompter is provided on the game board; or the first sensing element is electrically connected to the prompter, and the prompter is provided on the decisive game piece.

3. The klotski game of claim 2, wherein the decisive game piece comprises an upper casing and a lower casing nested and fitted with each other, and the first sensing element is located between the upper casing and the lower casing; and/or wherein the game board comprises an upper board body and a lower board body nested and fitted with each other, and the second sensing element is located between the upper board body and the lower board body.

4. The klotski game of claim 1, wherein a smart display region is provided on the game board; and the smart display region is provided with a display screen, and the prompter comprises the display screen, a buzzer, and/or an LED light.

5. The klotski game of claim 4, wherein the smart display region is further provided with a processing module and a power supply module; the power supply module supplies power to the display screen and the processing module; the display screen is located on a surface of the smart display region; the processing module is located inside the smart display region; the display screen is electrically connected to an output end of the processing module, and the second sensing element is electrically connected to an input end of the processing module.

6. The klotski game of claim 5, wherein the smart display region is further provided with a control button module, and the control button module is electrically connected to the input end of the processing module; or the display screen is a touch screen, and the display screen is further electrically connected to the input end of the processing module.

7. The klotski game of claim 4, wherein the display screen is provided with a 4×5-grid color rendering region, the color rendering region is configured to be capable of displaying at least three different colors, and each of the colors is configured to respectively correspond to a different type of game pieces among the plurality of game pieces.

8. The klotski game of claim 1, wherein a first accommodating cavity is provided in each of the game pieces, a first magnetic member is provided in the first accommodating cavity; a second accommodating cavity is provided in the game board, and a second magnetic member capable of attracting the first magnetic member is provided in the second accommodating cavity.

9. The klotski game of claim 8, wherein the first sensing element is a magnetic element, a magnetic pole of the first sensing element is opposite to a magnetic pole of the first magnetic member, and the second sensing element is a Hall sensor.

10. The klotski game of claim 8, wherein an upper surface of the game board is provided with a concave game piece sliding recess, the second magnetic member is arranged in an area where the game piece sliding recess is located, and the game pieces are attachable within the game piece sliding recess.

11. The klotski game of claim 9, wherein a height of the game piece is greater than a depth of the game piece sliding recess.

12. The klotski game of claim 1, wherein a wedge-shaped protrusion is provided at a corner of the game board.

13. The klotski game of claim 8, wherein the game pieces further comprise first-typed game pieces and second-typed game pieces, each of the first-typed game pieces is a square game piece having a length of one-unit length and a width of one-unit length, each of the second-typed game pieces is a rectangular game piece having a length of two-unit lengths and a width of one-unit length, and the decisive game piece is a square game piece having a length of two-unit lengths and a width of two-unit lengths.

14. The klotski game of claim 13, wherein twenty second magnetic members are arranged in a 4×5 matrix in the game board; each of the first-typed game pieces is provided with one first magnetic member, the decisive game piece is central symmetrically provided with two first magnetic members or four first magnetic members, and each of the second-type game pieces is provided with two first magnetic members which are symmetrical with respect to a central line.

15. The klotski game of claim 8, wherein the first magnetic member is swingable in the first accommodating cavity, and/or the second magnetic member is swingable in the second accommodating cavity.

16. The klotski game of claim 15, wherein a bottom surface of the first magnetic member is disposed on a bottom wall of the first accommodating cavity, an angle between the bottom surface of the first magnetic member and the bottom wall of the first accommodating cavity is a first swing angle, and the first swing angle is less than or equal to 45°; and/or the second magnetic member is swingable in the second accommodating cavity, a bottom surface of the second magnetic member is disposed on a bottom wall of the second accommodating cavity, an angle between the bottom surface of the second magnetic member and the bottom wall of the second accommodating cavity is a second swinging angle, and the second swinging angle is less than or equal to 45°.

17. The klotski game of claim 15, wherein when each of the game pieces is moved in position, the first magnetic member slaps an inner wall of the first accommodating cavity by swinging, and/or the second magnetic member slaps an inner wall of the second accommodating cavity by swinging.

18. A klotski game, comprising:

a plurality of game pieces comprising a decisive game piece;

a game board, configured to accommodate the plurality of game pieces and provided with a smart display region, the smart display region including a processing module and a power supply module, wherein the processing module is located inside the smart display region; and a display screen located on the surface of the smart display region, the display screen comprising a prompter configured to indicate that a game of the klotski game is over when the decisive game piece is moved to a position corresponding to an exit on the game board wherein the display screen is electrically connected to an output end of the processing module.

* * * * *